US007392564B1

(12) United States Patent
Ferris

(10) Patent No.: US 7,392,564 B1
(45) Date of Patent: Jul. 1, 2008

(54) DOME CLEANING DEVICE

(75) Inventor: William Ferris, San Diego, CA (US)

(73) Assignee: Dotworkz, San Diego, CA (US)

( * ) Notice: Subject to any disclaimer, the term of this patent is extended or adjusted under 35 U.S.C. 154(b) by 0 days.

(21) Appl. No.: 11/696,789

(22) Filed: Apr. 5, 2007

Related U.S. Application Data

(60) Provisional application No. 60/789,438, filed on Apr. 5, 2006.

(51) Int. Cl.
*A47L 13/10* (2006.01)

(52) U.S. Cl. ..... 15/210.1; 15/233

(58) Field of Classification Search ..... 15/209.1, 15/210.1, 233
See application file for complete search history.

(56) References Cited

U.S. PATENT DOCUMENTS

| | | | | | |
|---|---|---|---|---|---|
| 659,168 | A | * | 10/1900 | Foskett | 15/233 |
| 737,135 | A | * | 8/1903 | Peacock | 15/233 |
| 932,039 | A | * | 8/1909 | Marshall | 15/233 |
| 4,010,508 | A | * | 3/1977 | Komatsu | 15/104.94 |
| 4,827,556 | A | * | 5/1989 | Corsetti | 15/244.1 |

* cited by examiner

*Primary Examiner*—Mark Spisich
(74) *Attorney, Agent, or Firm*—Frank G. Morkunas

(57) ABSTRACT

A cleaning device for spherical-shaped covers for light fixtures and security cameras. The device has a plurality of flexible blades with an expandable cleaning pad attached to the tips of the blades. As the device is pushed onto a spherical dome cover, the blades flex outward permitting the pad to expand to the farthest end of the exposed dome. The device is rotated thereby rotating the cleaning pad and in the process, wiping the cover clean.

11 Claims, 2 Drawing Sheets

DOME CLEANING DEVICE

CROSS REFERENCES TO RELATED APPLICATIONS

This application claims the benefit of U.S. Provisional Application No. 60/789,438 filed on Apr. 5, 2006.

STATEMENT REGARDING FEDERALLY-SPONSORED RESEARCH OR DEVELOPMENT

None.

BACKGROUND

This device of this disclosure relates to an improvement in lens-cover cleaning devices, and more particularly to dome-type covers for security cameras and light fixtures having such dome-type covers which resemble a half-sphere; i.e., up to 180°.

These types of dome covers generally are elevated and seated upon a pole. The greater the relative height of the security camera or light fixture, the greater the area of surveillance or illuminations. For a security camera also, the greater the stealth of location, the less likely it will be seen by intruders and the more likely it will maintain unimpaired surveillance.

The dome lens of the cameras and light fixtures faces downward. Regardless of this configuration, the dome lens will attract dust, dirt, and other environmental fallout and over time will obscure the lens. The greater the build-up, the greater the visual obstruction especially for a security surveillance camera thereby minimizing if not defeating the purpose of the camera. Maintaining a clean lens is therefore extremely important to the functionality, efficiency, and effectiveness of the camera and light fixtures.

Because of their height and, in particular for security cameras, their location, cleaning the dome covers is difficult, cumbersome, and oftentimes, dangerous. A person engaged in these duties must in many cases bring, set up, and use a bulky ladder; must lean precariously out of a nearby window; or buy or rent an expensive lift.

The dome-cover cleaner of the present disclosure eliminates the dangers previously associated with cleaning dome covers for security cameras and light fixtures and also eliminates the excessive costs associated with such cleanings when using safety equipment for that purpose. The dome-cover cleaner of the present disclosure is an easy-to-use device from ground level which can reach the most obscure of locations and with a simple rotation, clean dome covers without scratching or streaking the lens in the process. It is durable, long-lasting, and inexpensive in cost, use, and maintenance.

The foregoing has outlined some of the more pertinent objects of the dome-cover cleaner of the present disclosure. These objects should be construed to be merely illustrative of some of the more prominent features and applications of the dome-cover cleaner of the present disclosure. Many other beneficial results can be attained by applying the disclosed dome-cover cleaner of the present disclosure in a different manner or by modifying the dome-cover cleaner of the present disclosure within the scope of the disclosure. Accordingly, other objects and a fuller understanding of the dome-cover cleaner of the present disclosure may be had by referring to the summary of the dome-cover cleaner of the present disclosure and the detailed description of the preferred embodiment in addition to the scope of the dome-cover cleaner of the present disclosure defined by the claims taken in conjunction with the accompanying drawings.

SUMMARY

The above-noted problems, among others, are overcome by the dome-cover cleaner of the present disclosure. Briefly stated, the dome-cover cleaner of the present disclosure contemplates a dome-cleaning device for cleaning a spherically-shaped cover wherein the device has a base with means for removably receiving an external rod-like member; a plurality of flexible blades attached to the base and extending upward from the base, each blade having a blade body and a blade tip; and a cleaning pad with a plurality of expandable elastic arms equal in number to the number of flexible blades and a pocket on each distal end of the elastic arms wherein the pockets of each elastic arm is removably insertable over a respective blade tip. The cleaning pad is adapted to expand outward in tandem with the flexible blades as they flex outward when placed over the spherical cover.

As such, the dome-cover cleaner of the present disclosure is designed to increase routine maintenance efficiency by reducing the time it takes to properly clean the exposed spherical-type dome cover of a security camera or spherical-type dome for a light fixture. The dome-cover cleaner is designed to extend onto the dome cover which protects the lens of a security camera by using standard extension poles while operated from underneath the dome cover. The unit is engineered to clean spherical, half domes, and "mini" domes without streaking or scratching the surface being cleaned.

The blade tip with cleaning pad may also be used to clean out-of-the-way flat structures and optical camera lenses more easily and without streaking or scratching the surface being cleaned.

The foregoing has outlined the more pertinent and important features of the dome-cover cleaner of the present disclosure in order that the detailed description that follows may be better understood so the present contributions to the art may be more fully appreciated. Additional features of the dome-cover cleaner of the present disclosure will be described hereinafter which form the subject of the claims. It should be appreciated by those skilled in the art that the conception and the disclosed specific embodiment may be readily utilized as a basis for modifying or designing other structures and methods for carrying out the same purposes of the dome-cover cleaner of the present disclosure. It also should be realized by those skilled in the art that such equivalent constructions and methods do not depart from the spirit and scope of the dome-cover cleaner of the present disclosure as set forth in the appended claims.

BRIEF DESCRIPTION OF THE DRAWINGS

For a fuller understanding of the nature and objects of the dome-cover cleaner of the present disclosure, reference should be had to the following detailed description taken in conjunction with the accompanying drawings in which.

DETAILED DESCRIPTION

Figure 1:
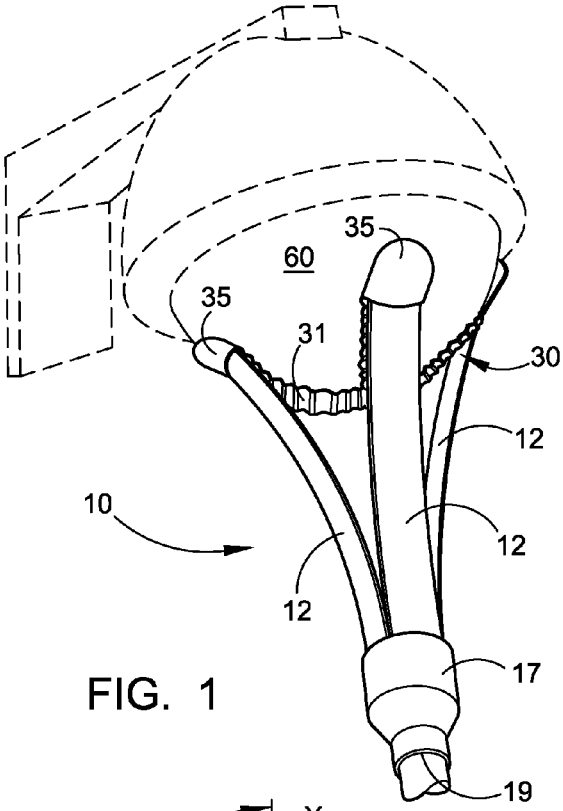
FIG. 1 is perspective view of the dome-cover cleaner engaging a dome lens.
Figure 2:
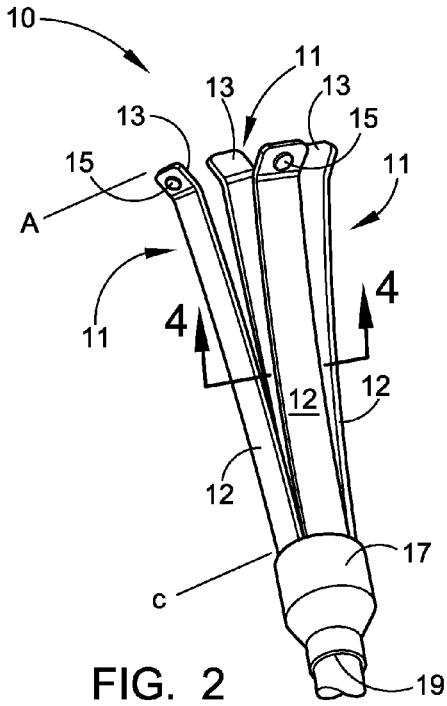
FIG. 2 is a perspective view of the dome-cover cleaner with cleansing pad removed therefrom.

Referring now to the drawings in detail and in particular to FIGS. 1 and 2, reference character 10 generally designates a dome-cover cleaner of the present disclosure constructed in accordance with a preferred embodiment thereof. The base 17 has a receiving member 19 on its bottom for receiving and retaining an external object such as, but not limited to, a pole or a rod. The receiving member 19 may be threaded with cooperating threading on the pole or rod, or the pole or rod may be friction-fitted into and retained by the receiving member 19.

Several blades or fingers 11 extend upward from the base 17. A cleansing pad 30 is fitted onto the blades 11 at their distal end. There are four such blades 11 illustrated though any plurality of from three or more may be on the base 17 for effective use of and lense cleaning by the dome-cover cleaner 10. Each blade 11 has a relatively straight blade body 12 and a blade tip 13. The blade tips 13 are angled outward of the blade body 12 to facilitate engagement of the dome-cover cleaner 10 to a dome lens.

FIG. 1 illustrates the dome-cover cleaner 10 engaging a dome-type lens 60 for cleaning. It must be understood that although a dome lens for a light fixture is represented by phantom-line in this figure, a dome lens of a security camera is similar in structure and the dome-cover cleaner is extremely well-suited for cleaning all types of dome covers. As the angled blade tips 13, with cleansing pad 30 thereon, engage the dome lens 60, the angling and upward thrusting into the dome lens 60 causes the blades 11 to flex outward.

With the continued thrust of the dome-cover cleaner 10 onto the dome 60 and the outward flexing of the blades 11, the blade tips 13, with cleansing pad 30 thereon, ride up the dome 60 to its farthest exposed ends. Once at that location, the user rotates the pole on which the dome-cover cleaner 10 is attached. As the pole rotates, so too does the dome-cover cleaner 10 with cleansing pad 30 attached. Such rotation of the cleansing pad 30 as it fully engages the dome 60 cleans the dome 60 in a simple and effective fashion.

Figure 5:
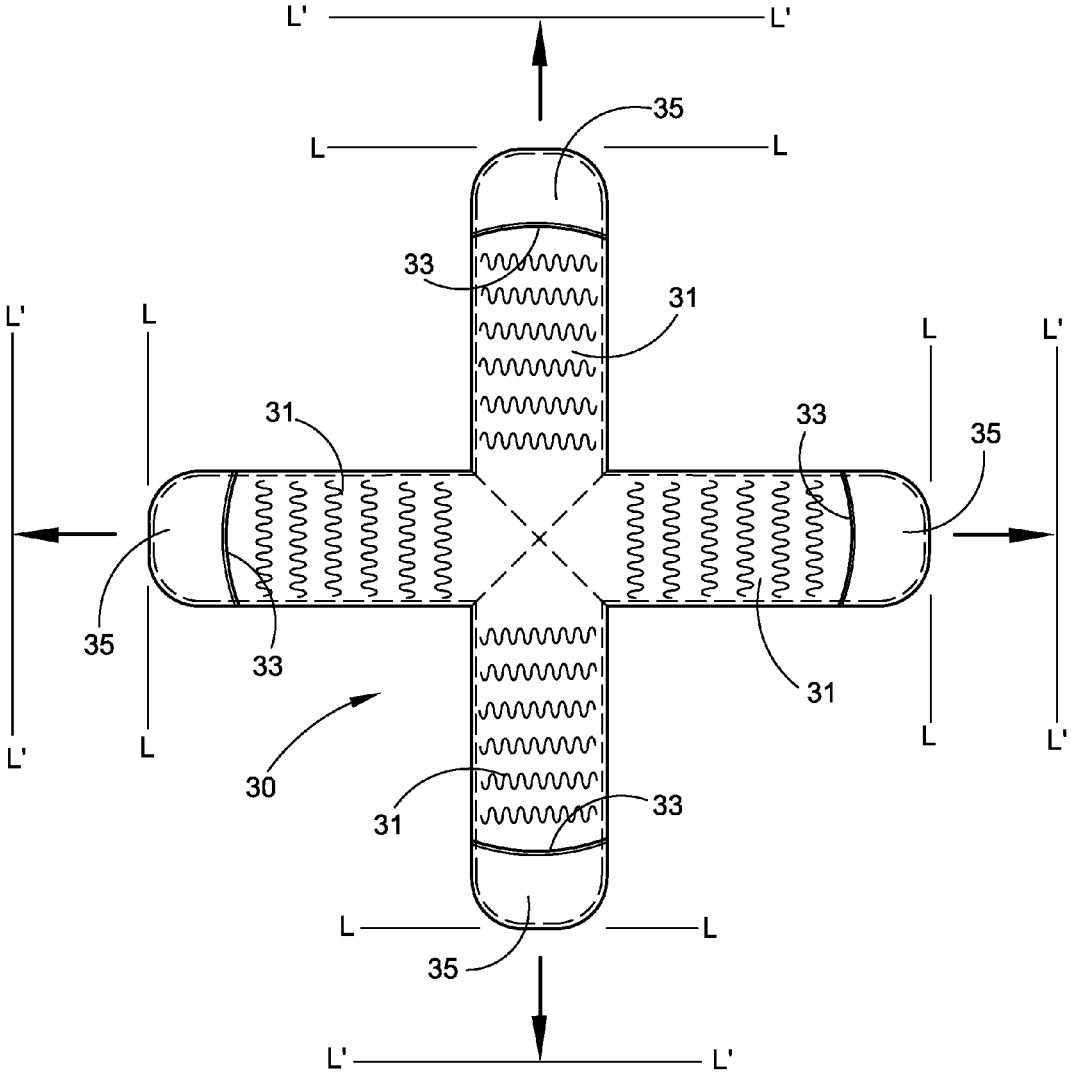
FIG. 5 is a plan view of the pad of the dome-cover cleaner in its contracted state.

Details of the cleansing pad 30 are illustrated in FIG. 5. The cleansing pad 30 has a plurality of arms 31 which should be equal in number as the number of blades 11. The distal end 35 of each arm 31 has a pocket or sleeve 33 which insert over the blade tips 13. The blade tips 13 also have an attachment member 15 [see FIG. 2] to more securely hold the cleansing pad 30 onto the blade tips 13. Any conventional attachment member 15 suited for the intended purpose may be used, such as, but not limited to, conventional gluing, snap-type fasteners, or hook-and-eye type fasteners, but it has been found that a Velcro®-type attaching component works quite well given the materials suited for the cleansing pad 30, particularly on the best-suited micro fibers discussed below.

The cleansing pad 30 should be of any conventional micro fiber, cotton or cotton blend, or other natural or synthetic fibers, or combinations thereof, suited for the intended purpose. The type of micro fiber best suited for this cleaning purpose are micro fibers which consist of micro fiber thread (between approximately 60% to approximately 80% polyester and approximately 20% to approximately 40% polyamide) woven with over 90,000 fibers per square inch. These types of micro fiber threads will absorb up to seven times their weight in water and as a result are extremely well-suited for the cleaning purpose for domes lenses made of plastics and glass materials or combinations thereof.

The arms 31 have an elastic feature which permit the arms 31 to expand as the blades 11 engage the dome 60 and move outward. FIG. 5 illustrates the cleansing pad 30 in its contracted or normal state. Reference characters L-L represent the contracted or normal lengths of the arms 31. The arms 31 are adapted to expand the distance represented by reference characters L'-L'. Given the flexibility of the blades 11 as to their dimensions [to be detailed below], the degree of expansion of the arms 31 should range from approximately 50% to approximately 80% past the distance of L-L.

For example, and only by way of example and not by way of limitation, if the distance from the distal end 35 of one arm 31 to the distal end 35 of its opposing arm 31 is 9-inches, the expansion to L'-L' will be from about 4.5-inches to 7.2-inches giving the cleaning length of the respective arms 31 between about 13.5-inches to 16.2-inches.

Figure 3:
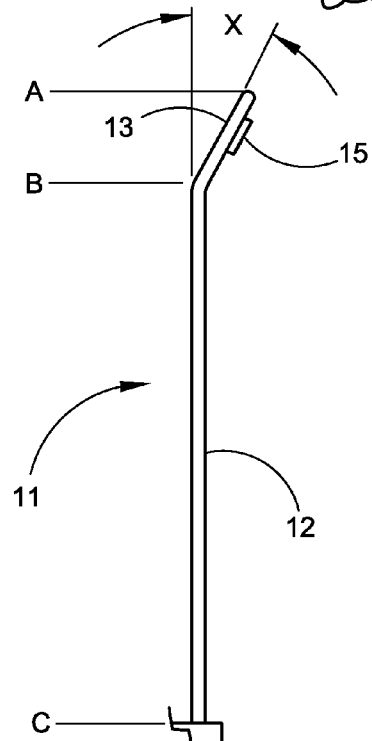
FIG. 3 is an elevation side view of one blade of the dome-cover cleaner.
Figure 4:
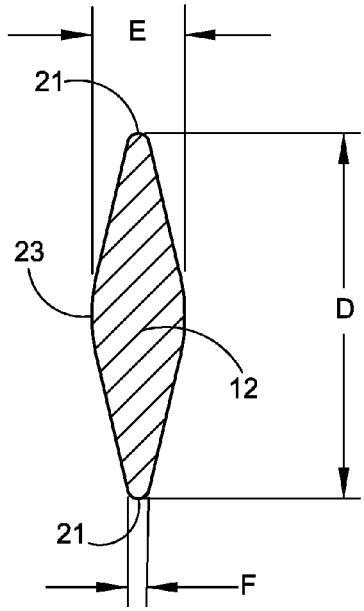
FIG. 4 as taken on line 4-4 of FIG. 2 is a cross-section view of one blade of the dome-cover cleaner.

Blade 11 dimensions and characteristics are best described by reference to FIGS. 3 and 4. The blade height of each blade 11 is represented by reference characters A-C. Each blade 11 has a blade body 12 and a blade tip 13. The blade tip 13 is angled from the blade body 12 at point B bearing angle X. Angling is an important feature as previously described above. In this regard, angle X of blade tip 13 should range from approximately 10° to approximately 70° outward of the blade body 12. It has been found that best effectiveness is attained what an angle X of Each blade 11 must exhibit a torsion rigidity and lateral resistance sufficient to permit the blade 11 to flex outward without breaking as the dome-cover cleaner 10 is thrust onto the dome 60 and to return to its relaxed state without deformation. These characteristics lend to an effective dome-cover cleaner 10 and a longer useful life.

The composition of the blades 11 should be such that the blades 11 have a uniform flexural strength and compressive strength to insure proper rebound and ductile behavior when engaged against the dome lens. In this regard and to achieve proper contact through the common size ranges of dome structures, the blades 11 should provide a minimum of at least 2 to 4 pounds per square inch [PSI] of tensile strength when measured from blade top to bottom.

Dimensions also play a significant role in the blade characteristics of torsion rigidity and lateral resistance. The overall blade 11 height is represented by reference characters A-C; the blade body 12 length represented by reference characters B-C, and the blade tip 13 length by reference characters A-B. The blade 11 also resembles a diamond-like shape in cross-section [see FIG. 4].

The longitudinal center 23 of the blade 11 is thicker than its side edges 21. The center thickness is represented by reference character E and the side edge thickness is represented by reference character F. The width of the blade 11 is represented by reference character D.

In this regard, for best torsion rigidity and lateral resistance for the blades 11, the side edge 21 thickness F should be approximately between 5% to approximately 30% of the thickness of the center 23, E. For example, and only by way of example and not by way of limitation, if the thickness E is 0.25-inches and thickness F is 0.0625-inches, then thickness F would be approximately 25% that of thickness E though, as stated above, thickness F could range from approximately 5% to approximately 30% as that of thickness E.

The blade body 12 length B-C should be approximately between 80% to approximately 95% as that of the blade 11 height A-C. For example, and only by way of example and not by way of limitation, if the length of the blade body 12 is approximately 11.5-inches and the height of the blade 11 is approximately 12.5-inches, then the blade body 12 length B-C is approximately 92% that of the blade 11 height A-C though, as stated earlier, the blade body 12 length B-C could range from approximately 80% to approximately 95% as that of the blade 11 height A-C.

The blade tip 13 length A-B should be approximately between 5% to approximately 20% as that of the blade 11 height A-C. For example, and only by way of example and not by way of limitation, if the length of the blade tip 13 is 1.0-inches and the height of the blade 11, is approximately 12.5 then blade tip 13 length A-B is approximately 8% that of the blade 11 height A-C though, as stated earlier, the blade tip 13 length A-B could range from approximately 5% to approximately 20% as that of the blade 11 height A-C.

The width D of the blade 11 should be approximately 10% to approximately 20% as that of the blade body 12 length B-C. For example, and only by way of example and not by way of limitation, if the blade 11 width D is 1.5-inches and the blade body 12 length B-C is 11.5-inches, then the blade 11 width D is approximately 13% that of the blade body 12 length B-C though, as stated earlier, the blade 11 width D could range from approximately 10% to approximately 20% as that of the blade body 12 length B-C.

Given all these relative dimensions of the blade 11, blade body 12, blade tip 13, and blade cross-sectional shape, width, and varying thickness in conjunction with the composition of the blade 11, excellent torsion rigidity and lateral resistance are achieved to make the dome-cover cleaner of this disclosure extremely useful, effective, and novel.

The present disclosure includes that contained in the present claims as well as that of the foregoing description. Although this dome-cover cleaner of the present disclosure has been described in its preferred forms with a certain degree of particularity, it is understood that the present disclosure of the preferred forms has been made only by way of example and numerous changes in the details of construction and combination and arrangement of parts may be resorted to without departing from the spirit and scope of the dome-cover cleaner of the present disclosure. Accordingly, the scope of the dome-cover cleaner of the present disclosure should be determined not by the embodiment[s] illustrated, but by the appended claims and their legal equivalents.

Applicant[s] have attempted to disclose all the embodiments of the dome-cover cleaner of the present disclosure that could be reasonably foreseen. It must be understood, however, that there may be unforeseeable insubstantial modifications to dome-cover cleaner of the present disclosure that remain as equivalents and thereby falling within the scope of the dome-cover cleaner of the present disclosure.

What is claimed is:

1. A dome-cleaning device for cleaning a spherically-shaped cover comprising:

(a) a base having means for removably receiving an external rod-like member;

(b) a plurality of flexible blades attached to said base and extending upward therefrom, wherein each one of said plurality of flexible blades has a pre-determined blade width, a pre-determined blade height comprising a blade body with a blade body length and a blade tip with a blade tip length wherein said blade tip is angled outward of said blade body by approximately between 10° and approximately 70°; and (c) a pad having a plurality of expandable elastic arms equal in number to said plurality of flexible blades and a pocket on each distal end of said plurality of expandable elastic arms wherein said pocket of each said plurality of expandable elastic arms is removably insertable over a respective blade tip of each one of said plurality of flexible blades, said plurality of expandable elastic arms is further adapted to expand outward in tandem with said plurality of said flexible blades as said plurality of flexible blades flex outward when placed over the spherically-shaped cover.

2. The dome-cleaning device of claim 1 further comprising retaining means for retaining said pad onto said plurality of flexible blades, said retaining means on each said blade tip.

3. The dome-cleaning device of claim 2 wherein said retaining means comprises conventional gluing or use of a hook or a loop component of a hook-and-loop fastener.

4. The dome-cleaning device of claim 1 wherein said blade body length is approximately 80% to approximately 95% of said pre-determined blade height.

5. The dome-cleaning device of claim 4 wherein said blade body comprises a tensile strength of at least approximately between 2 pounds per square inch to approximately 4 pounds per square inch.

6. The dome-cleaning device of claim 1 wherein said blade tip length is approximately 5% to approximately 20% of said pre-determined blade height.

7. The dome-cleaning device of claim 1 wherein each one of said plurality of flexible blades has a thickness at its side edges which is approximately 5% to approximately 30% less than its thickness at its center.

8. The dome-cleaning device of claim 1 wherein said plurality of expandable elastic arms are expandable from approximately 50% to approximately 80% of their contracted state.

9. The dome-cleaning device of claim 1 wherein said blade width is approximately 10% to approximately 20% as that of the blade body length.

10. The dome-cleaning device of claim 1 wherein said pad is comprise of a water-absorbent material selected from the group consisting of cottons, cotton blends, and micro fibers.

11. The dome-cleaning device of claim 10 wherein said micro fibers comprise approximately 90,000 fibers per square inch wherein said micro fibers are approximately 60% to 80% polyester and approximately 40% to approximately 20% polyamides.

* * * * *